US008434705B2

(12) United States Patent
Lipowski

(10) Patent No.: US 8,434,705 B2
(45) Date of Patent: May 7, 2013

(54) SHREDDING DEVICE WITH COUNTER KNIFE ASSEMBLY

(75) Inventor: Wolfgang Lipowski, Seck (DE)

(73) Assignee: Vecoplan AG, Bad Marienberg (DE)

( * ) Notice: Subject to any disclaimer, the term of this patent is extended or adjusted under 35 U.S.C. 154(b) by 182 days.

(21) Appl. No.: 12/975,948

(22) Filed: Dec. 22, 2010

(65) Prior Publication Data

US 2011/0147504 A1 Jun. 23, 2011

(30) Foreign Application Priority Data

Dec. 23, 2009 (DE) ..... 10 2009 060 523

(51) Int. Cl.
*B02C 25/00* (2006.01)
*B02C 7/00* (2006.01)

(52) U.S. Cl.
USPC ..... 241/29; 241/30; 241/239; 241/241; 241/242; 241/286

(58) Field of Classification Search ..... 241/29, 241/239, 240, 241, 242, 243, 286, 30
See application file for complete search history.

(56) References Cited

U.S. PATENT DOCUMENTS 1,739,135 A * 12/1929 Foresman ..... 241/227
2,156,619 A * 5/1939 Carruthers et al. ..... 241/240
2,225,781 A 12/1940 Hinerfeld
3,584,796 A * 6/1971 Earle et al. ..... 241/4
3,790,093 A * 2/1974 McIntyre ..... 241/73
5,368,238 A * 11/1994 Bergkamp et al. ..... 241/30
5,390,862 A * 2/1995 Eglin ..... 241/29
5,911,372 A * 6/1999 Williams, Jr. ..... 241/32
6,565,026 B1 * 5/2003 Hall ..... 241/225

FOREIGN PATENT DOCUMENTS

DE 297 02 876 U1 4/1997
DE 103 33 359 B3 1/2005
EP 0 419 919 B1 12/1993

* cited by examiner

*Primary Examiner* — Faye Francis
(74) *Attorney, Agent, or Firm* — Alston & Bird LLP

(57) ABSTRACT

This invention relates to a shredding device having a driving unit driving a rotor including shredding tools on its periphery which for comminuting a material such as waste material and/or industrial residues, interact with a least one counter knife assembly that is arranged in a stationary fashion with respect to the machine housing during the shredding operation. The shredding device is characterized in that the counter knife assembly includes at least two counter knife bars which run approximately parallel to each other and are arranged one above the other in the rotating direction of the rotor, the counter knife bars, for the compensation of wear at the shredding tools and/or at the counter knife assembly, being arranged for an adjustment radially to the rotor axis by a mutually different degree by means of an adjustment device. A process for operating a shredding device is also described.

16 Claims, 10 Drawing Sheets

SHREDDING DEVICE WITH COUNTER KNIFE ASSEMBLY

BACKGROUND OF THE INVENTION

This invention relates to a shredding device, comprising a driving unit for driving at least one rotor having shredding tools on its periphery which for shredding material to be comminuted, for instance waste material and/or production residues, interact with at least one counter knife assembly that is arranged in a stationary manner with respect to the machine housing of the device during the shredding operation. The invention also relates to a process for operating such a shredding device.

Such shredding devices are used for instance for comminuting wood, paper, plastics, rubber, textiles, production residues or waste material from industry and commerce but also bulky waste, domestic refuse, paper and DSD (Duales System Deutschland=German dual system) collections such as hospital waste etc. The material to be processed is shredded by a cutting, shearing, crushing, tearing and/or grinding operation of the rotor cooperating with its associated stationary counter knife assembly. A device of this type is described for example in patents EP 0 419 919 B1 and DE 103 33 359 B3.

Normally, the counter knife assembly is adapted in its design to the surface of revolution of the shredder shaft for comminuting the shredding material, which surface of revolution is determined by the shredding tools. If the shredding tools have for instance a tooth structure, the counter knife assembly may have a complementary tooth structure of the counter knives in such a manner that the teeth of the rotary tool mesh with the teeth of the counter knives during the shredding process. The clearance between the shredding tools and the counter knife assembly is a decisive factor for the shredding operation, particularly if the material to be comminuted includes thin constituent parts such as films or textiles.

In the course of operation of the device, both the shredding tools and the counter knife assembly, in the described example the counter knife teeth interacting with the shredding tools, will become worn. For this reason, the shredding tools and the counter knives must be regularly exchanged. Known by prior art is also a counter knife assembly including a knife bar which after a predetermined operation time or in response to a predetermined wear, is radially displaced toward the rotor in order to reduce the gap between the wearing shredding tools and the wearing counter knife during a maintenance period in which no processing of shredding material takes place. In cases in which both the shredding tools and the counter knife assembly have a tooth structure, the teeth and particularly the teeth flanks will not wear symmetrically, so that as a result the clearance cannot be uniformly reduced over the entire tooth structure by the displacement of the counter knife assembly toward the rotor. Instead, with an increasing wear, the gaps remaining between the teeth of the rotor tools and the counter knives become increasingly large, even if the counter knife assembly is advanced as far as to contact the shredding tools. Especially in cases in which the material to be processed includes also films and textiles, the tools or the counter knives must be exchanged in order to again provide for the required clearance which is sufficiently narrow for comminuting even such materials. Operational availability of the device is considerably limited by the exchange of these shredding means.

BRIEF SUMMARY OF THE DISCLOSURE

The invention is based on the object of reducing the maintenance requirements of a shredding device of this kind and thus increasing operational availability of the system.

This object is achieved by the present invention in a surprisingly simple way, by virtue of the fact that the shredding device has a counter knife assembly that includes at least two adjacent counter knife bars that extend approximately parallel to the rotor axis and parallel to one another and are arranged one above the other in the rotor direction, the knife bars being arranged for displacement radially to the rotor axis by a mutually different amount by means of an adjustment device, for compensation of wear at the shredding tools and/or the counter knife assembly.

It can be provided also that the maximum adjustment path is different for both counter knife bars.

According to the invention, the at least one counter knife assembly includes a least two adjacent counter knife bars that together constitute the counter-means for and are adapted to the respective shredding tool. Preferably, the two counter knife bars can be fixed to a common counter knife traverse that can extend parallel to the rotor axis. Furthermore, over the surface of revolution of the shredder shaft plural (for example two or three) such counter knife assemblies can be arranged.

The fact that the two counter knife bars of a counter knife assembly that are disposed one above the other in the rotating direction of the rotor are arranged so as to be adjustable differently from each other in the radial direction with respect to the rotor, provides for a higher degree of adjustment of the shredding device to the given wear that occurs at the shredding tools and also at the counter knife assembly. The operational availability of the device of the invention is thus increased.

It should be noted that the displacement of the counter knife bars can also take place in a direction including both a component in the radial direction and a component in the circumferential direction. Such a displacement is beneficial especially in cases in which a clearance angle between the shredding tools is adjustable at the rotor and at the counter knives.

It is particularly useful if the displacement of the two counter knife bars which are arranged one above the other in the rotor direction takes place in mutually parallel directions.

The term "counter knife bar" denotes a device in the form of a sequence of counter knives which can be customized for the shredding tools, depending on the respective design. For instance, both the shredding tools and the counter knife bars can include a tooth structure meshing with each other during operation. The flanks of the teeth can be straight or also corrugated. On the other hand, it is also possible for the shredding tools and the associated counter knives to have a smooth, straight structure, especially if adapted to the shredding material. In this case, the knives are also known as block knives or plain knives. Such a counter knife bar normally extends constantly spaced from the rotor, mostly parallel to the rotor axis. Further, it can be designed in a one-piece or multi-piece fashion in the longitudinal direction.

The adjustment device for the radial adjustment of the at least two counter knife bars with respect to the rotor axis by a mutually different degree can comprise for example a plurality of associated screws by means of which the respective knife bars can be fixed with respect to the rotor. Normally, the adjustment device can comprise means with which the radial adjustment of the at least two counter knife bars with respect to the rotor axis can be made completely independently from one another, i.e. the adjustment of one counter knife bar has no influence on the radial position of the other counter knife bar. Furthermore, it is also possible to adjust the counter knife bars in a motor-driven manner.

All known driving units for driving the shredder rotor, for instance synchronous/asynchronous or hydraulic motors, with or without an interposed transmission, are suitable for use with the shredding device of the invention. It is also possible to use two motors which are respectively flanged to one end of the rotor.

Further advantageous embodiments are stated in the subclaims.

Especially for the purpose of providing for a very small clearance between the shredding tools and the counter-means on the counter knife assembly throughout the running time of the shredding tools on the rotor or on the counter knife bar, the wear at the lower knife bar can be set larger using constructional measures than the wear at the rotor tools, particularly due to a different design with respect to the geometry such as the thickness of the lower knife bar or the rotor tools, due to a different material for the lower knife bar or the rotor tools, due to a different hardness of the material of the lower knife bar or the rotor tools and/or due to a different number of rotor tool bars on the rotor compared to the number of the lower knife bars over the operating range of the rotor tools. By using such design measures, the wear of the lower knife bar during the interaction of the rotor tools and the lower knife bar is defined. This makes it possible that during advancing the lower knife bar into the operating area of the shredding tools, the former can be machined by the rotor tools, so that a very small clearance is set.

After the completion of such a maintenance phase, the shredding device of the invention is again ready for comminuting comparatively thin material such as films, textiles and similar material, since the clearance between the tools and the counter knife assembly has been minimized. It is particularly useful in this respect for the upper knife bar of the counter knife assembly to be adjusted in its wear approximately equally to the wear at the rotor tools. Here, too the wear of the upper knife bar with respect to the rotor tools can be adjusted via geometry such as the thickness, the material, the material hardness or the number of rotor tool bars or counter knife assemblies over the surface of revolution of the shredding device. The upper counter knife bar for instance can be designed harder and thicker than the lower counter knife bar.

Most expediently, the at least two counter knife bars with their associated contact surfaces directly lie one on the other. On the other hand, it can also be provided that between the two counter knife bars an intermediate layer is disposed which does not interact with the rotor tools. Preferably, the upper knife bar is supported on the lower knife bar. Maintenance intervals can be shortened if a support of the counter knife assembly is provided on which the lower counter knife bar is supported. Most expediently, the upper knife bar is supported on the lower knife bar and the latter on the support, thus providing a particularly simple and inexpensive structure for the counter knife assembly.

The term "upper counter knife bar" denotes the counter knife bar of the counter knife assembly that is disposed above the lower counter knife bar with respect to the rotating direction of the rotor.

For supporting both counter knife bars for radial displacement with respect to the rotor, a removable wedge bar can be provided which for applying a clamping force rests with one of its lateral surfaces on the counter knife bar being the upper counter knife bar in the rotating direction of the rotor, so that the at least two counter knife bars are clamped between a support and the wedge bar. The wedge bar produces a clamping force in an approximately tangential direction to the rotor, so that both counter knife bars are pressed onto the support. A displacement of one or both counter knife bars in the radial direction can be performed as soon as the wedge bar is removed. Preferably, the wedge bar has a triangular cross section, in particular isosceles or equal-sided.

Advantageously, one or both counter knife bars can be segmented in the longitudinal direction, which allows coping with a varying wear over the working area of the rotor or the counter knife assembly.

For instance, the amount of wear is normally highest in the central part of the counter knife bars over their longitudinal extension, so that it is possible by this measure to exchange only the relevant part of the counter knife bar or bars. Furthermore, such a constructional measure makes maintenance easier. A shredding device of this type can comprise an operating area of several meters, so that the segmentation of the corresponding assemblies, for instance of the counter knife bars, enables their handling without complicated lifting devices.

The maintenance requirements are even further reduced if the counter knife assembly includes a counter knife traverse, particularly a cylindrical counter knife traverse that is mounted to the machine housing of the shredding device and has mounted to it the at least two counter knife bars. It will be achieved by this measure that after removing the counter knife traverse from the machine housing of the shredding device, the same can be moved in such a manner that the at least two counter knife bars are accessible for maintenance purposes and especially for the exchange of the counter knife bars or their segments.

A particularly advantageous embodiment provides for the counter knife traverse to be cylindrically formed. Additionally, a supporting device extending radially outwards with respect to the rotor can be provided on which the counter knife traverse can be rolled off over its lateral surface, after releasing the fastening. The counter knife bars can thus be rolled from the inside of the shredding device to the outside by an easy rotation of the cylindrical counter knife traverse, so that the counter knife bars are accessible for maintenance purposes, e.g. for an exchange. Most expediently, the supporting device can provide a first limit stop for the counter knife traverse, said limit stop limiting the movement of the counter knife traverse to the outside of the operation area of the rotor. Moreover, it can be useful to provide a second limit stop for the counter knife traverse on the machine housing, wherein a mounting means on the counter knife traverse corresponding to a complementary mounting means on the machine housing will come to rest when it arrives at this second limit stop. For example, after the counter knife traverse contacts the second limit stop for fixing the second operating position of the counter knife traverse, a pin guide in the traverse corresponding to a pin guide in the machine housing may come to rest, so that for fixing the traverse to the machine housing a fixing pin can be inserted through both guides.

Concerning the process, the object of the invention is solved by a process for operating a shredding device, wherein a driving unit drives a rotor including shredding tools on its periphery which for shredding material to be comminuted, such as waste material and/or production residues, interact with a counter knife assembly which is arranged in a stationary manner with respect to the machine housing during the operation time. The process of the invention is characterized in that for the counter knife assembly at least two counter knife bars are provided which extend approximately parallel to each other and are disposed one above the other in the rotating direction of the rotor, wherein for the compensation of wear at the shredding tools and/or at the counter knife assembly the at least two counter knife bars are arranged for displacement radially to the rotor axis by a mutually different amount, i.e. the two counter knife bars can be adjusted radially to the rotor by a mutually different amount.

Most expediently, in the process of the invention, pre-shredding of the shredding material is performed by an interaction of an upper counter knife bar in the rotating direction of the rotor with the shredding tools and re-shredding of the coarsely shredded material is performed by an interaction of the lower counter knife bar in the rotating direction of the rotor with the shredding tools. It is thus achieved that during re-shredding comparatively thin materials to be shredded such as textiles and fibers can be comminuted.

For again improving the operation of the shredding device after a certain degree of wear, it can be useful that for the compensation of wear of the shredding tools and/or of the upper counter knife bar in the rotating direction of the rotor, the upper counter knife bar is displaced radially in the direction of the rotor until it contacts or almost contacts the lower counter knife bar by at least one of the shredding tools. This process step reduces the cutting channel between the counter knife bars and the shredding tools.

A further improvement, particularly with regard to thin shredding material, can be achieved in that for the compensation of wear of the shredding tools and/or of the lower counter knife bars in the rotating direction of the rotor, the lower counter knife bars are displaced during a maintenance period up and into the radial operation area of the shredding tools, so that the lower knife bar is machined by the shredding tools to a very small clearance between the shredding tools and the knife bar. Here it is expedient that during this maintenance period no shredding material is processed, i.e. the device runs "empty" and is operated at a low rotational speed of the rotor lower than the usual rotational speed for the shredding process. By the described step of the process the lower knife bar is adapted to the wear of the shredding tools in a manner optimal for adjusting a small clearance, since the lower knife bar is machined by the shredding tools. Most expediently, moving the lower knife bar into the rotor can also be performed in a motor-driven way. As already explained above, the term "clearance" denotes the distance between the cutting edges or flanks of the shredding tools and the cutting edges or flanks on the lower or upper counter knife bar.

To reduce maintenance requirements, it can be useful for the counter knife assembly to be formed by a cylindrical traverse to which the at least two counter knife bars are fixed, the traverse being detachably supported on the machine housing and being supported on the lateral area thereof in such a manner that it can be rolled off radially away from the rotor so as to grant access to the counter knife bars.

The object of the invention is also achieved by a second embodiment of the shredding device, comprising a driving unit which drives at least one rotor which is provided on its periphery with shredding tools which for comminuting shredding material such as waste material and/or production residues interact with at least one counter knife assembly which is disposed in a stationary manner with respect to its machine housing during the shredding operation of the device. The shredding device of this embodiment is characterized in that the counter knife assembly comprises a counter knife traverse which is detachably mounted to the machine housing of the shredding device and to which at least one counter knife bar is fixed. Moreover, this embodiment can provide for a supporting device which extends radially outwards with respect to the rotor and on which the counter knife traverse can be rolled off over its lateral area after releasing the fastening, in order to make the at least one counter knife bar accessible. It should be noted that the second embodiment of a shredding device may additionally comprise individual features, a combination of several features or all features which can be comprised within the scope of the first described embodiment of a shredding device having a counter knife assembly and at least two counter knife bars.

BRIEF DESCRIPTION OF THE DRAWINGS

Embodiments of the invention and further important features of the invention will be described in the following with reference to the attached drawings, wherein it is shown by.

DETAILED DESCRIPTION OF THE DRAWINGS

Figure 1:
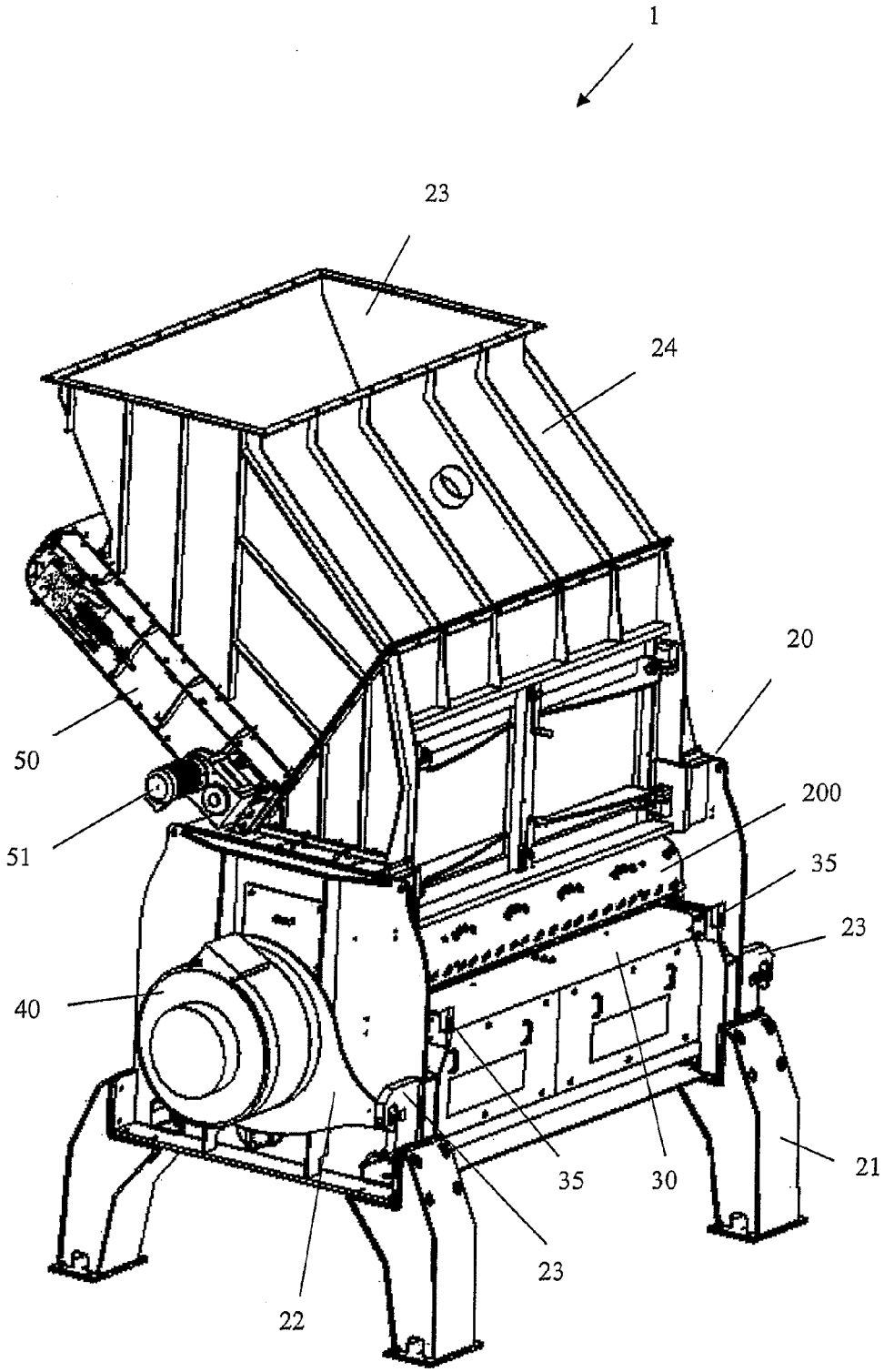
FIG. 1 an overall view of a shredding device of the invention.

FIG. 1 shows an overall view of the shredding device 1. On the machine housing 20 a shredder rotor is supported in the region of its longitudinal ends, and in the described embodiment a respective AC motor 40 is flanged gearless to each end. The driving unit is coupled to a machine housing 20 by means of a holder 23 and via a torque support 22 for receiving a reaction torque during the operation of the device. In the illustration of FIG. 1, the second AC motor for driving the rotor is concealed, but the holder 23 can be seen, through which also the second motor for receiving the reaction torque is coupled to the housing 20 again by means of a torque support.

The shredding tools in the form of knife-tooth bars circumferentially arranged on the rotor interact with a counter knife traverse 200 for comminuting shredding material, which traverse is arranged stationary with respect to the housing 20 during the shredding process. In the figure, the shredding material is fed to the opening 24 of a sheet metal hopper 25 from above to then fall into the cutting chamber which is downwardly defined by the shredder rotor. To support feeding of the shredding material to the cutting chamber, a conveyor device 50 in the form of a chain conveyor is provided, which is driven by a motor 51.

In the illustrated embodiment, the device is supported on the ground via four legs 21. Between the legs a conveyor belt can be arranged which collects and carries away the comminuted material falling down.

FIG. 2*a* shows an embodiment of a rotor 100 of the shredding device 1 of the invention, which rotor carries rotary knife bars 110 on its circumference which in the described embodiment are inclined to the axis 105. In the present case, six such rotary knife bars are provided, but only three thereof can be seen in the figure. The inclined posture of the rotary knife bars 110 with respect to the shaft 105 has the advantage that with counter knife bars which are arranged parallel to the shaft 105, it always is only a part of the tools and knives which interact, so that the mechanical load of the device is reduced. In the figure, on one side thereof, also the bearing section 106 can be seen, by which the rotor is supported on this front side against the machine housing 20, see FIG. 1.

For making the assembly and maintenance easier, an individual rotary knife bar 110 is designed in a segment-like fashion, and in the described embodiment each bar comprises nine such segments. FIG. 2*b* shows an enlarged view of the detail A of FIG. 2*a*. Each of these segments is comprised of three parts which radially extend into the rotor 100 and are fixed to the rotor. On the one side, a contact segment 140 is provided, against which the knife segment 130, see FIG. 2*c*, is supported during the operation. The knife segment has a tooth structure with tooth flanks 132, 133 and a tip portion 131. As shown in FIG. 2*c*, the knife segment 130 has a tooth structure on both longitudinal sides, so that after said one tooth structure is worn, the segment can be used a second time by a simple rotation in the installed position by 180°. The knife bar 130 is clamped between the clamping segment 150 and the contact segment 140 by means of the clamping segment. In view of this fact, only the contact segment 140 and the clamping segment 150 are screwed together with the rotor, whereas the knife segment 130 is supported alone by the clamping force applied between the two other components.

Figure 2:
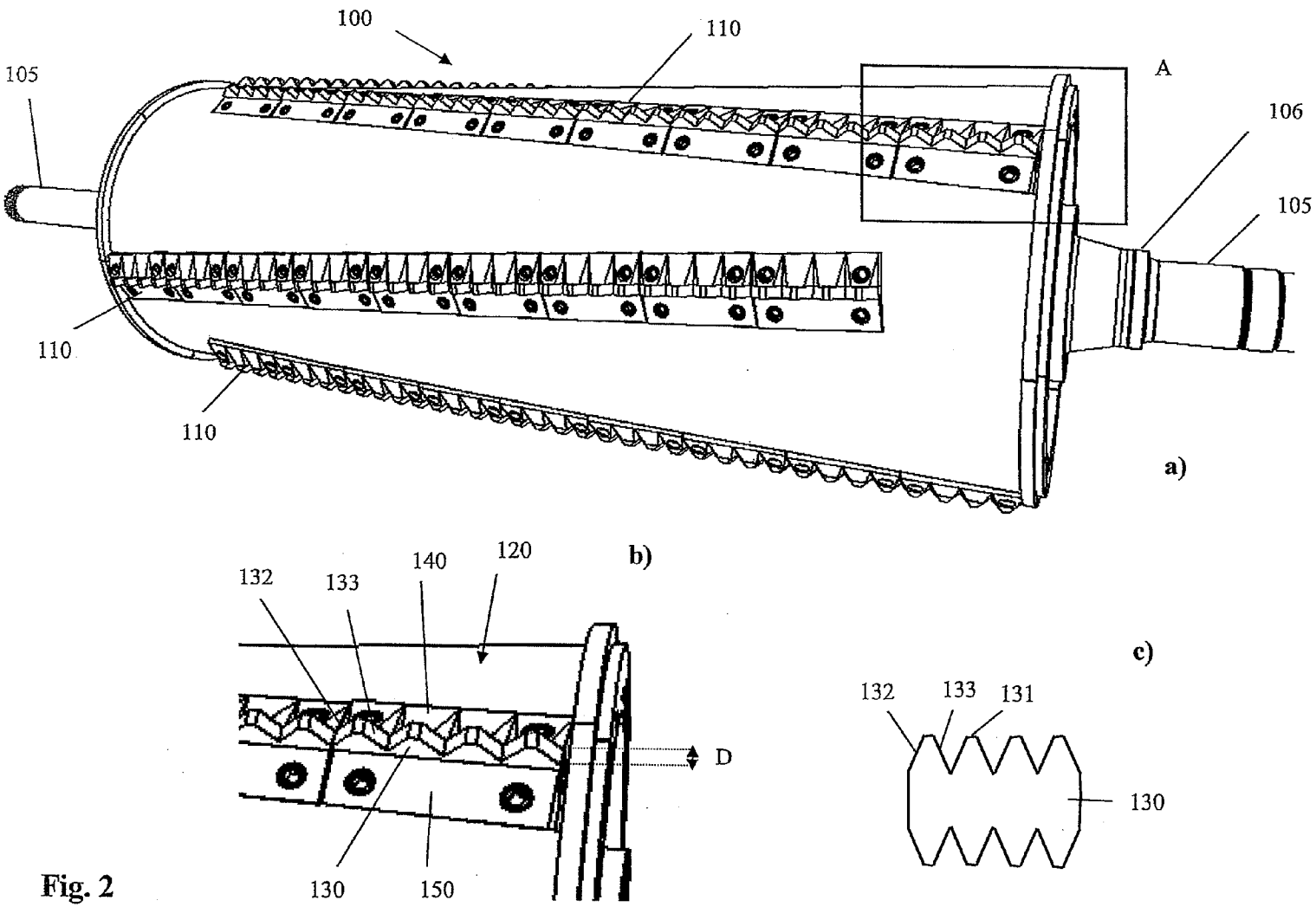
FIG. 2*a* the rotor with the shredding knife bars of the device according to FIG. 1 attached to its periphery.
FIG. 2*b* an enlarged view of detail A of FIG. 2*a*.
FIG. 2*c* a knife segment of the rotor according to FIG. 2*a*, in a lateral view.
Figure 3:
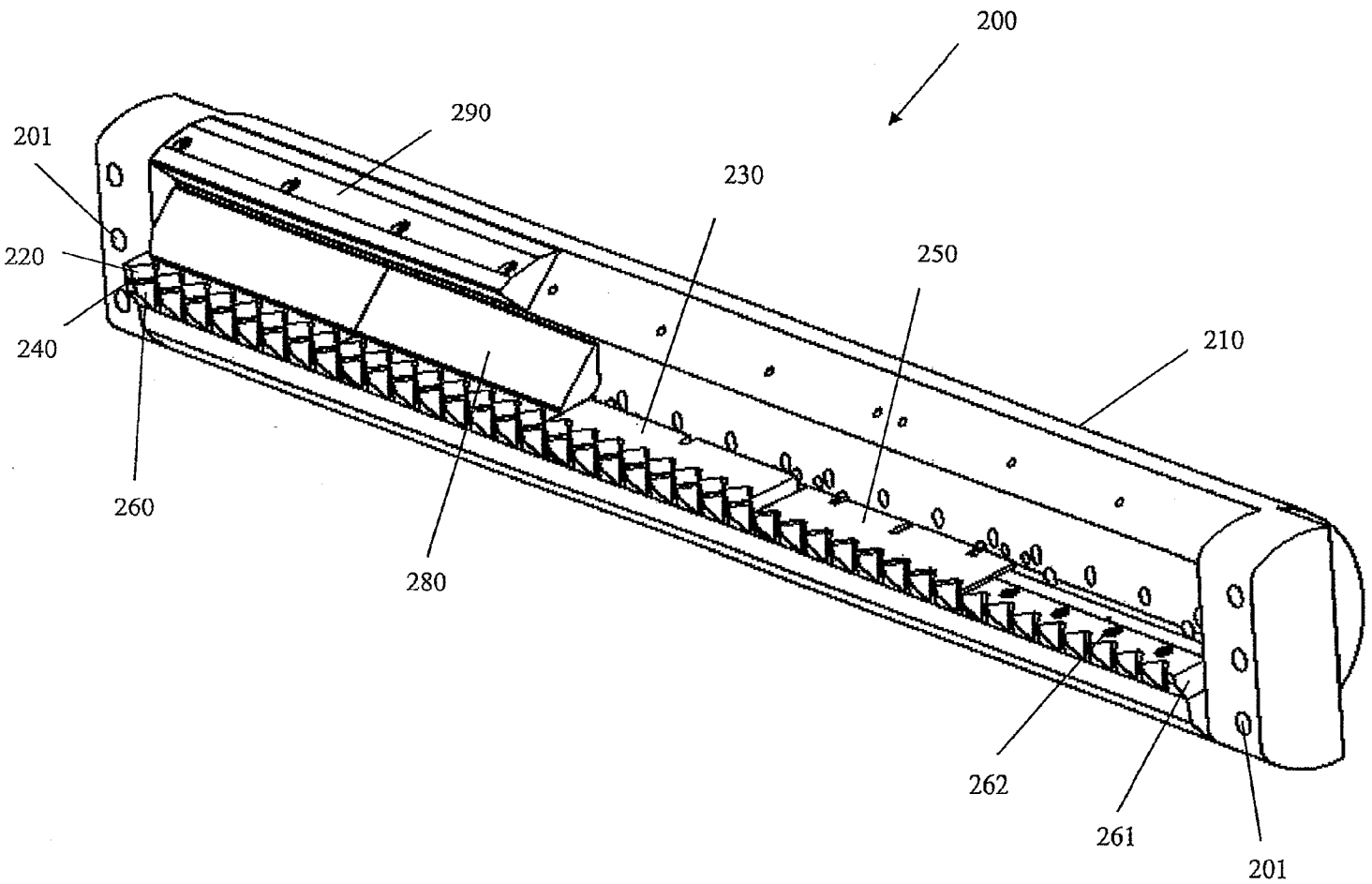
FIG. 3 a counter knife traverse of the device according to FIG. 1 with a partly mounted lower and upper counter knife bar.

FIG. 3 shows in a detail view an embodiment of a counter knife traverse 200 on which the counter knives for the interaction with the rotor illustrated in FIG. 2 are arranged. The counter knife traverse has a cylindrical base body 210 which in the region of its front sides includes in the transverse direction a number of passages 201 through which the traverse is fixed to the machine housing 20 by means of bolts, see FIG. 1. In the illustrated embodiment, the counter knife traverse carries an upper counter knife bar 220 and a lower counter knife bar 240. To facilitate the handling during the assembly or maintenance, also the two counter knife bars are segmented.

For better understanding the structure, different segments are illustrated in a different stage of completion. In the segment on the right side of the figure, merely the supporting segment 261 is shown which is fixed to the base body 210 using four screws 262. For supporting the counter knife bars even in the region of their tooth structure, the support includes an associated tooth structure. But it should be noted that in the described embodiment the support 260 or the supporting segments 261 do not interact with the rotor blades for comminution but exclusively have a supporting function with regard to the counter knife bars above the same.

In the segment which follows to the left in the figure, the counter knife segment 250 next to the supporting segment is shown which constitutes the lower counter knife segment in the direction of rotation of the rotor and which has a tooth structure corresponding to the tooth structure of the rotor blades, so that both tooth structures mesh with each other during operation. The lower counter knife bar or the lower counter knife segment is movably arranged on the support approximately vertically to the axis of the counter knife traverse 200, as will be discussed in more detail hereafter. In the described embodiment, the lower counter knife bar 240 is designed with a lower thickness than the upper counter knife bar 220—see the segment following to the left, in which also the upper counter knife segment 230 is mounted. As can be seen, also the upper counter knife segment has a tooth structure that corresponds to the tooth structure of the lower counter knife, so that in the end, the counter knife assembly formed by the two counter knife bars meshes with the rotor knife bars during operation. The upper counter knife segment is directly supported on the lower counter knife segment 250, so that both counter knife bars are supported by the support 260. Also the upper counter knife bar is arranged for displacement relative to the support 260 and vertically with respect to the longitudinal axis of the traverse, as will be explained in more detail in the following.

Both counter knife bars or both counter knife segments are pressed onto the support 260 via a wedge bar or a wedge bar segment 280 by an approximately vertical force on the lateral surface of the upper counter knife segment 230 which is produced by the wedge bar or the wedge bar segment 280. Over the length of the two counter knife bars, sealing wedge segments 290 are provided which are fixed to the base body 210 using screws and which perform a sealing function which will be discussed in more detail with reference to the following drawing figure. In FIG. 3 only a single sealing wedge segment 290 is illustrated, whereas in the completed state also the sealing wedge bar runs over the full extension of the wedge bar or of the two counter knife bars.

Figure 4:
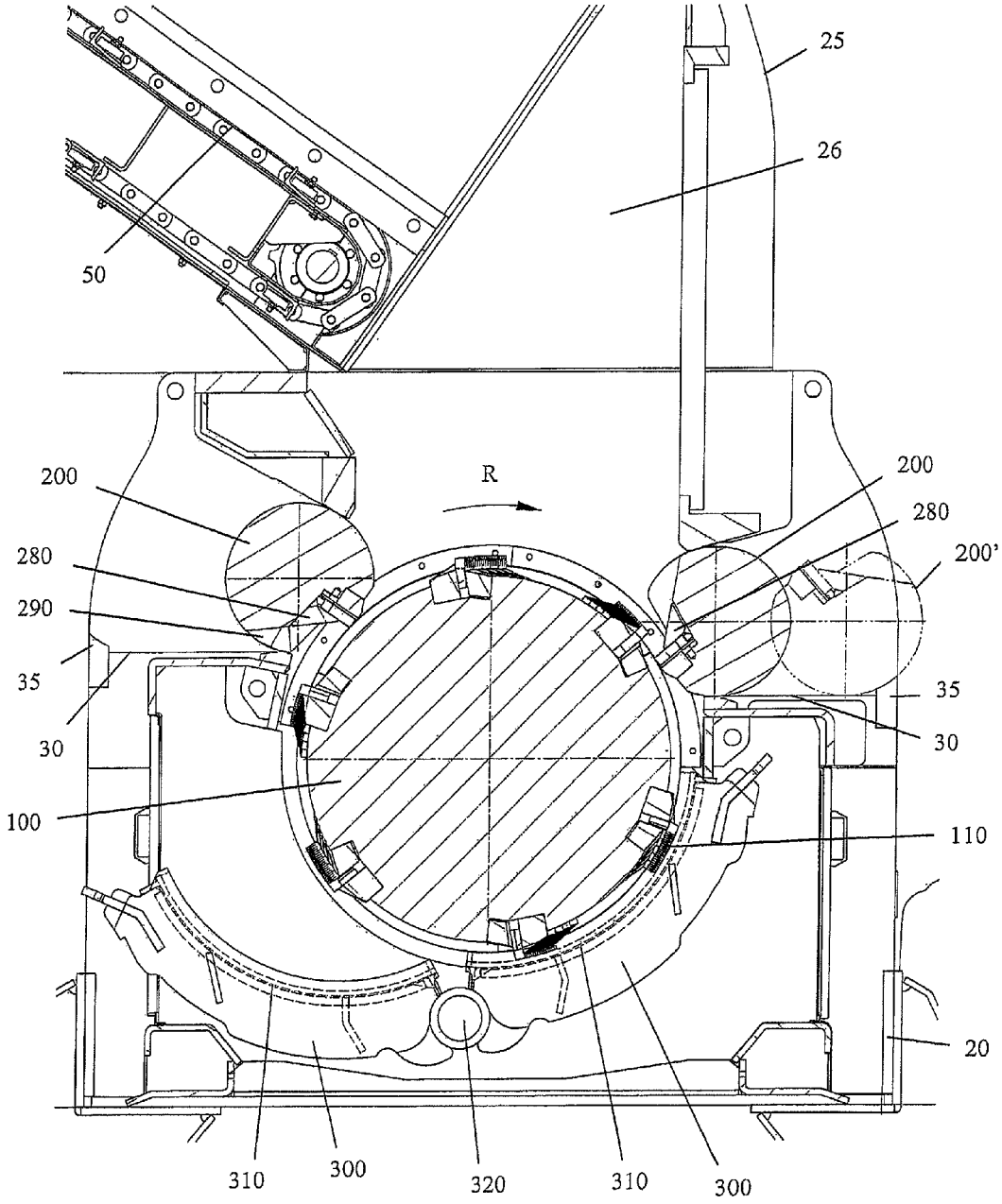
FIG. 4 a sectional view of sections of the shredding device of FIG. 1 vertically to the rotor axis.

FIG. 4 shows a detail in a section through the overall device according to FIG. 1 vertically to the rotor and approximately centrally with respect to the longitudinal extension thereof. The rotor 100 downwardly defines the cutting chamber 26 adjoining the sheet metal hopper 25, the shredding material being supplied to the cutting chamber 26 via the conveyor device 50. The rotor, see FIG. 2*a*, carries on its circumference six rotary knife bars which in the described embodiment interact with two counter knife traverses 200, see FIG. 3, in the manner as already described, for the comminution of the shredding material. For optimizing the shredding operation, both traverses are arranged above the rotor axis. The left traverse in FIG. 4, which interacts with the rotor tools for the purpose of re-shredding, is arranged in the vertical direction somewhat higher than the right traverse, which interacts with the rotor tools for the purpose of pre-shredding.

Since in the illustration of FIG. 4, the rotor 100 rotates in the clockwise direction, the knife bars first interact with the right counter knife traverse 200 in the figure. Below the counter knife traverses 200 a screen assembly with a supporting structure 300 for a screen 310 is arranged and the supporting structure is arranged for pivoting about a rotation axis 320 which is rigidly connected to the machine housing 20.

As far as the action of the rotor knife on the shredding material produces shredded material on the right counter knife traverse 200 which is smaller than the mesh size of the screen 310, the material will fall out from the device through the screen and for instance onto a conveyor belt (not shown). On the other hand, if the shredding material is larger in size than the mesh size of the screen, it will be moved along by the rotor knife bars 110 in the rotating direction and comminuted at the left counter knife traverse in FIG. 4 interacting with the rotor knives and thereafter falls downwards through the screen or is again transferred back to the cutting chamber 26.

In the described embodiment, the wear at the lower knife bar of a counter knife traverse is higher than the wear at the rotor tools, which is due to a different thickness of the lower knife bar or rotor knifes. Furthermore, both bars have a different material hardness. A further factor with respect to the mutual wear is determined by the number of knife bars on the rotor: the higher this number the higher the wear at the counter knife bars.

In the described embodiment, the upper knife bars on both counter knife traverses are thicker and harder than the associated lower knife bars.

In the situation illustrated in FIG. 4, one of the supporting structures 300 for a screen 310 is pivoted about the axis 320 and away from the rotor, for the purpose of maintenance.

To exchange or facilitate the exchange of counter knife segments or of complete counter knife bars, both counter knife traverses are substantially cylindrical so that after removing corresponding fixing means on the machine housing, the counter knife traverses a turned away from the rotor via a supporting plate 30 until they contact a limit stop 35, thus making the counter knife bars or counter knife segments accessible—see the maintenance position 200' of the right counter knife traverse indicated by the broken line in FIG. 4. A corresponding supporting plate 30 and a limit stop 35 are also provided for the left counter knife traverse in the figure, for turning the counter knife traverse 200 out of the operating area of the rotor.

In the described embodiment, both counter knife traverses are identical except of one detail. In contrary to the right counter knife traverse in FIG. 4, the left counter knife traverse comprises the sealing wedge segments 290 that have been described with reference to FIG. 3. These prevent shredding material which is transferred between the screen 310 and the rotor knife bars and back to the cutting chamber 26 from moving into parts of the housing where no further comminution takes place.

Figure 5:
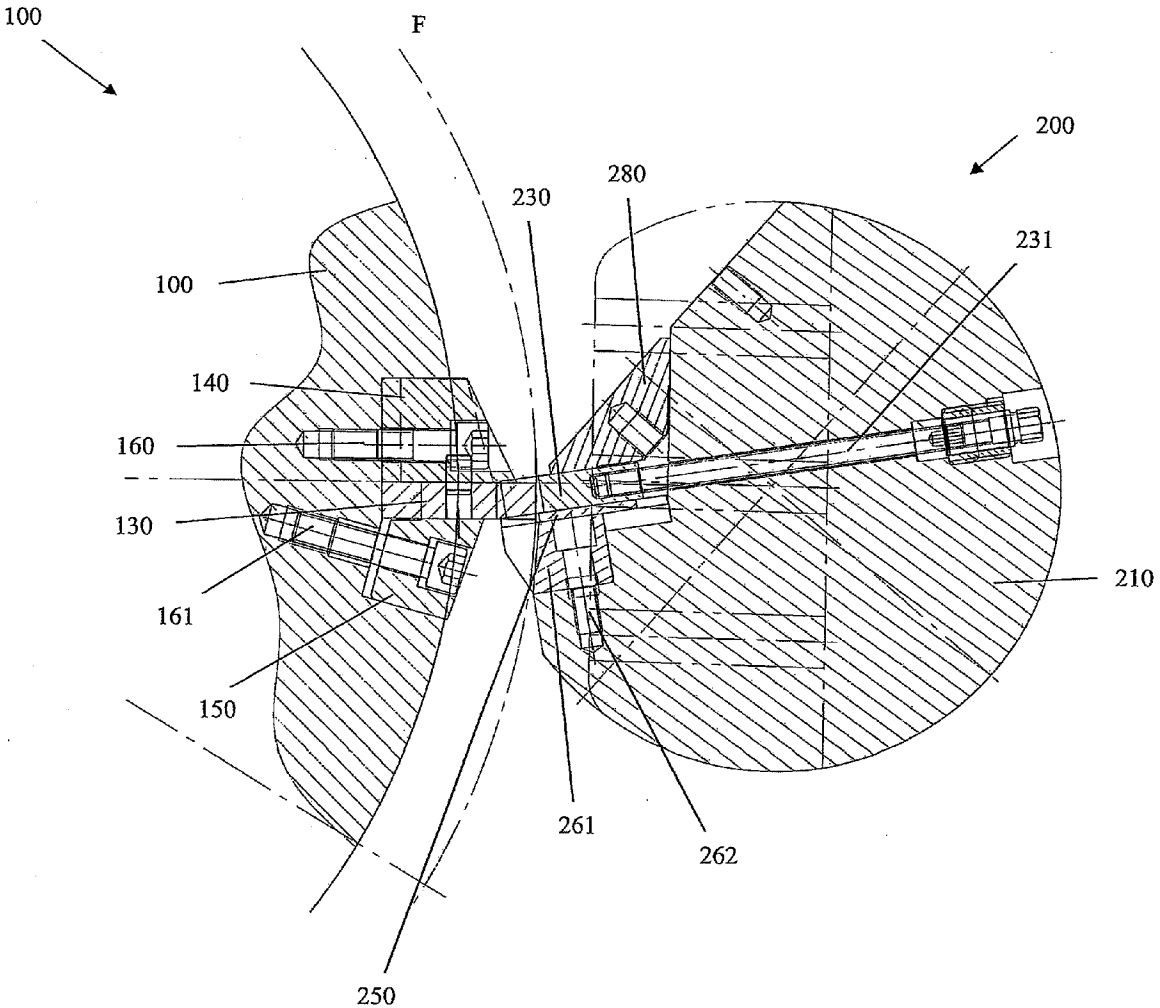
FIG. 5 an enlarged view of a detail of FIG. 4 with respect to the interaction of counter knife traverse and shredding tool at the rotor.

FIG. 5 shows the relative position of a rotor tool in a rotating position of the rotor 100 in which the toothed knife segment 130 meshes with the associated toothed counter knife segments 230, 250. Reference symbol F denotes the rotation surface of the rotor which due the meshing operation extends into the operating area of the counter knife traverse 200 and determines the operating area of the rotor.

As can be clearly seen in the sectional view, the counter knife segment 130 is wedged between the contact segment 140 and the wedge segment 150. Both the contact segment 140 and the wedge segment 150 are screwed to the rotor by means of bolted connections 160, 161, whereas the upper counter knife segment 230 is supported on the lower counter knife segment 250, the latter being supported against the contact segment 261 that is connected to the base body 210 of the counter knife traverse 200 by means of a screwed connection 262. In a manner still to be described, the wedge segment 280 exerts a force on the contact segment 261, for clamping the two counter knife segments 230, 250. As also illustrated, a clearance angle is provided between the counter knife bars and the rotor knife bars. Further, the thickness of the upper counter knife segment and the rotor knife segment 130 is approximately equal. Also shown is an adjusting bolt which is rigidly fixed to the upper counter knife segment 230, for displacing the upper counter knife segment toward the rotor. Details in this respect are discussed with reference to the following drawing figures.

Figure 6:
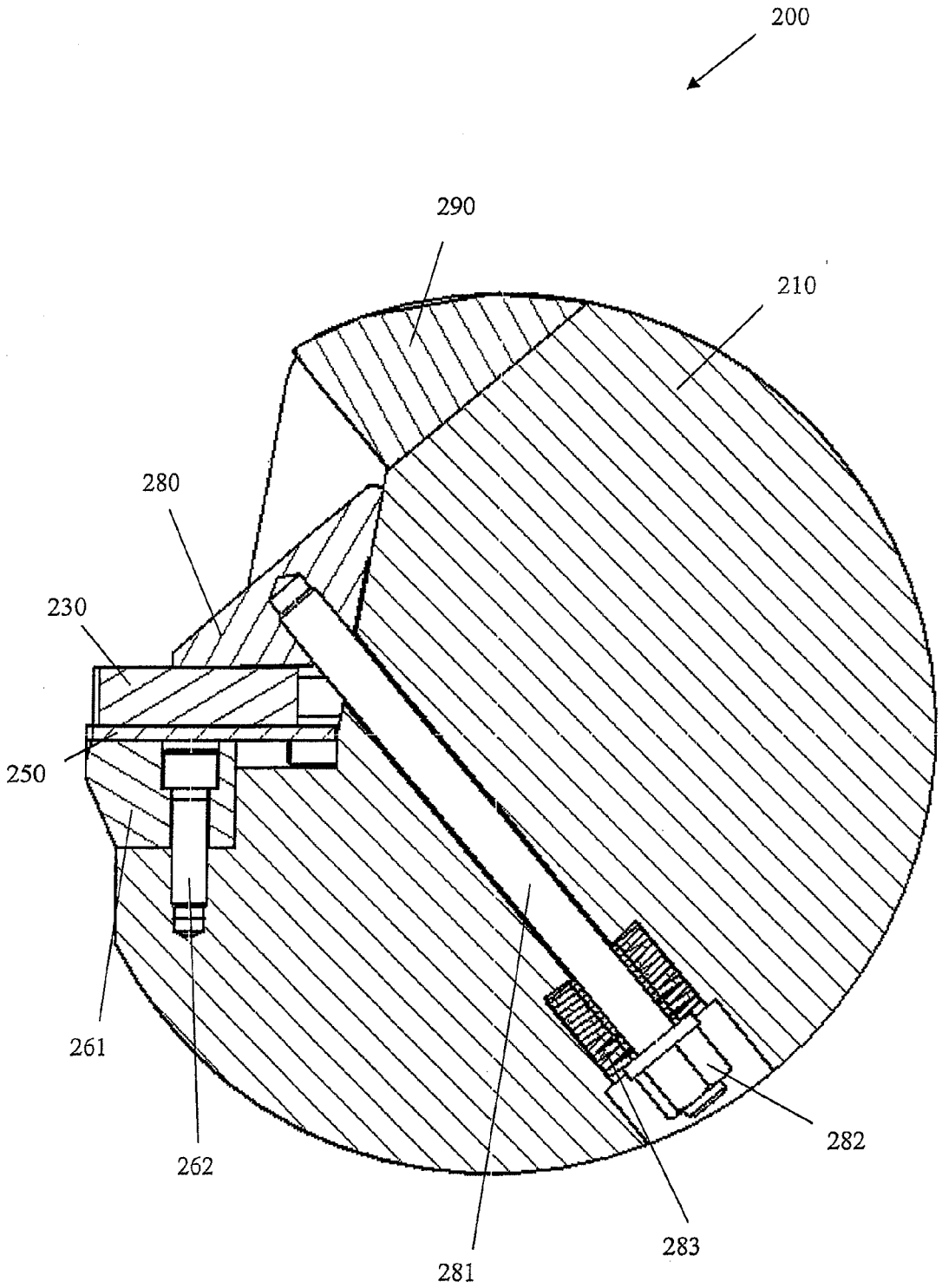
FIG. 6 the arrangement of the support for the two counter knife bars and the wedge bar on the counter knife traverse, in a sectional view.

FIG. 6 again shows a section through the traverse 200 of FIG. 4 vertically to the longitudinal axis of the traverse at a longitudinal position such that the fixing bolt 281 for fixing the wedge segment 280 is viewable. As can be seen, the fixing bolt 281 extends into the clamping wedge 280 and is rigidly connected to the same. On the rear end a counter bore is provided, so that the plate spring 283 and the nut 282 do not protrude over the circumference of the cylindrical traverse. By loosening nut 282, the clamping force vertically acting on the counter knife segments and on the support is removed or reduced, so that the counter knife segments 230, 240 can be adjusted in a direction to the rotor, for compensating wear at the tools.

Figure 7:
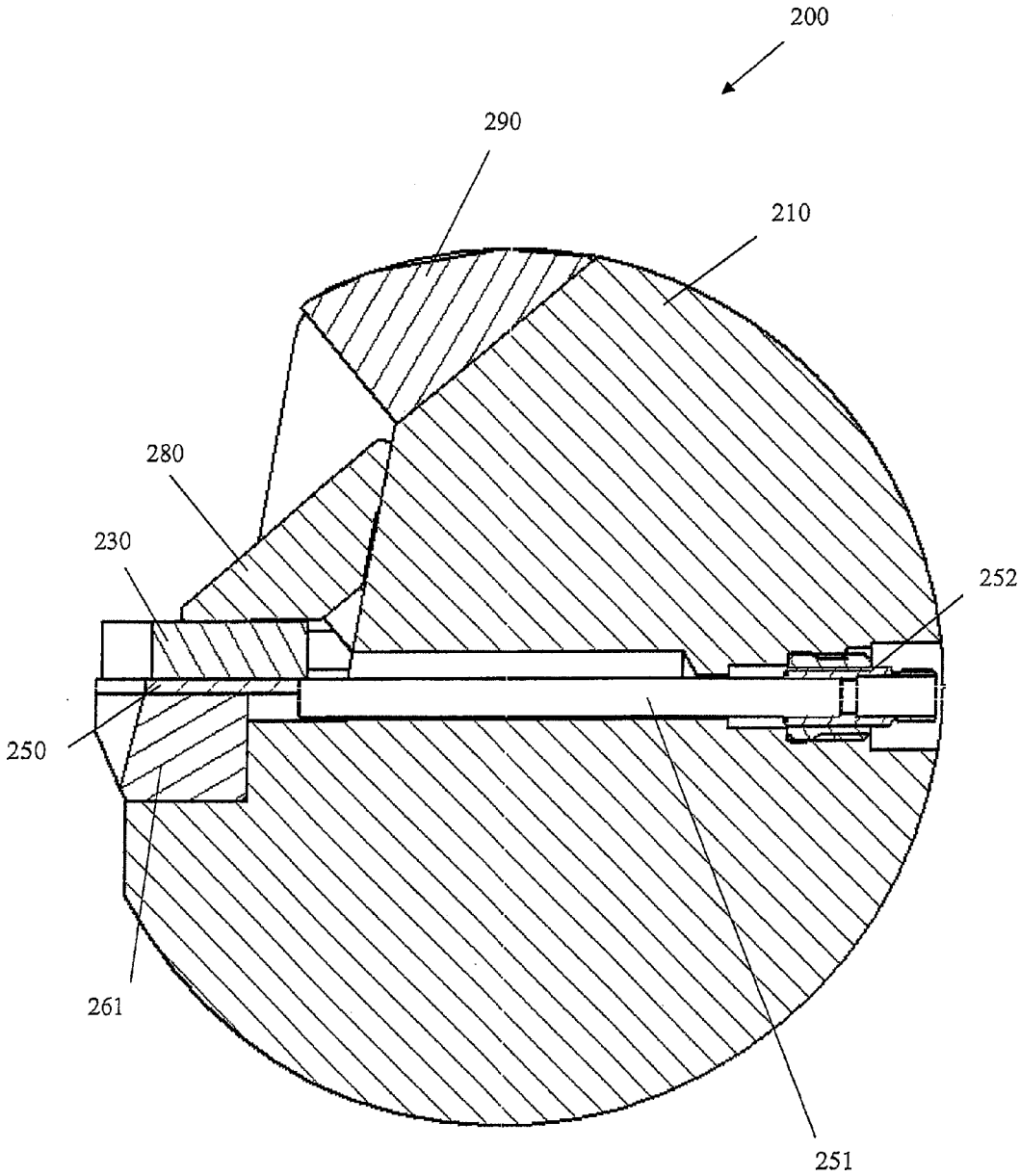
FIG. 7 the arrangement of the lower counter knife bar on the counter knife traverse, in a sectional view.

A corresponding section vertically to the axis of the traverse showing the adjusting bolt 251 for displacing the counter knife segment which is the lower counter knife segment in the rotating direction of the rotor, is shown by FIG. 7. In the present case, the bolt 251 is welded to the lower counter knife segment 250. At the rear end of the adjusting bolt 251, which extends transversely through the traverse, an adjustment mechanism 252 is provided through which the adjusting bolt with the lower counter knife fixed to it can be displaced toward the rotor, after having removed the wedge segment 280 arranged there above, see FIG. 6.

Figure 8:
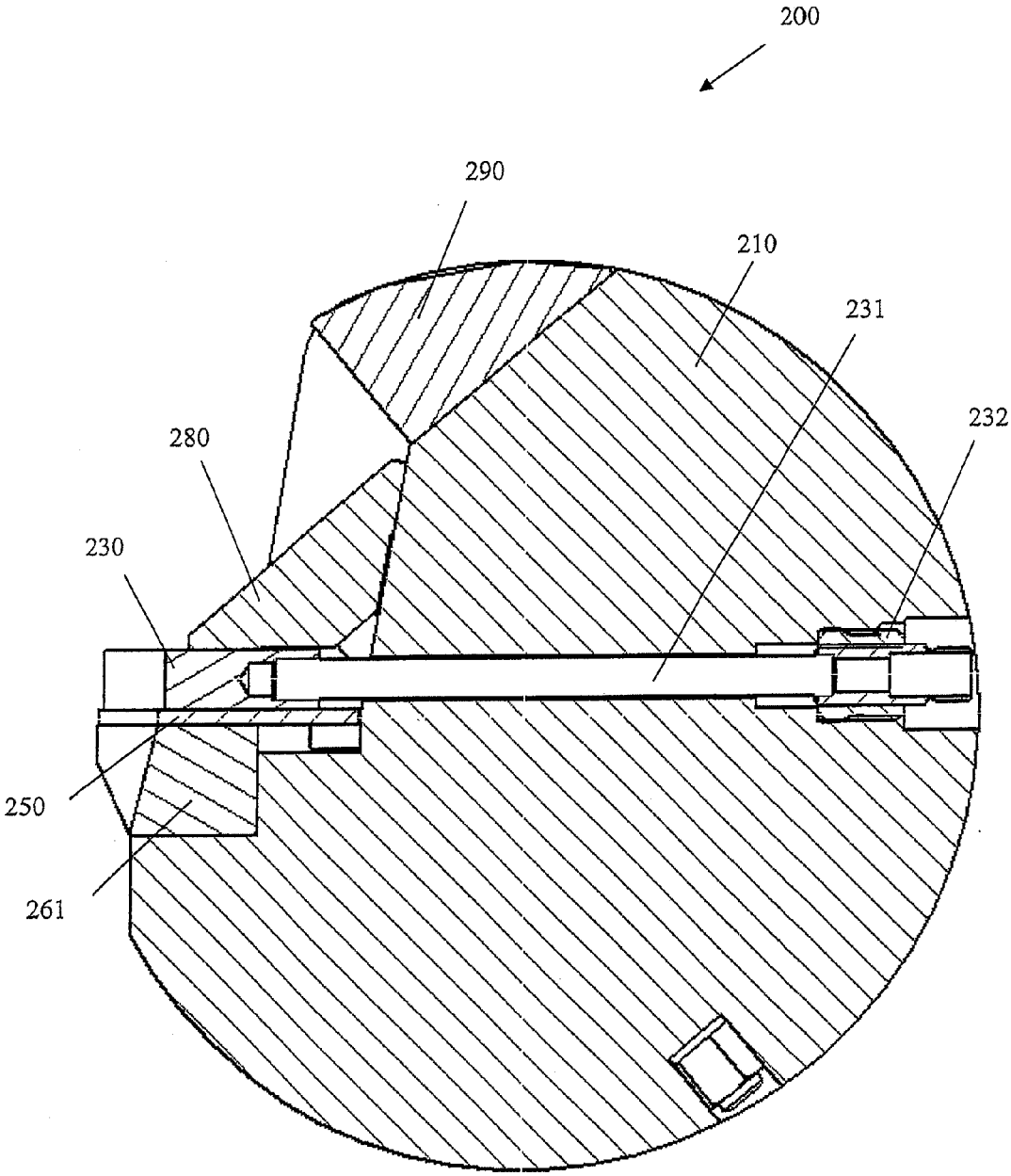
FIG. 8 the arrangement of the upper counter knife bar on the counter knife traverse, in a sectional view.

FIG. 8 shows a section vertically to the longitudinal extension of the traverse at a longitudinal position thereof at which the adjusting bolt 231 is shown which extends transversely through the traverse, for adjusting the upper counter knife segment 230. In this case, too an adjustment mechanism 232 is provided which is sunk into the counter knife traverse and through which the upper counter knife segment 230 can be displaced toward the rotor after the removal of the wedge segment 280, for the compensation of wear.

It should be noted that the fixing or adjustment of the various segments has been described with reference to singular adjusting bolts or fixing bolts. But in the described embodiment, several such bolts are provided for each segment for reasons of stability, see for instance FIG. 3 and FIG. 2.

Because of the fact that the lower counter knife segment or the lower counter knife bar is adjustable toward the shredding rotor differently from the upper counter knife segment or the upper counter knife bar, it is possible to again adjust very small clearances by performing corresponding adjusting work after the tools or the counter knives have become worn, so that it is again possible after such maintenance work to process thin materials such as films or textiles.

According to the invention, by the division of the counter knife assembly at least into two knife bars, especially mutually parallel knife bars, pre-shredding of the shredding material can be performed by the interaction of the upper counter knife bar in the rotating direction of the rotor with the shredding tools and re-shredding of the coarsely shredded material can be performed by an interaction of a lower counter knife bar in the rotating direction with the shredding tools.

When the tools or counter knives have worn out beyond the tolerable degree, one may proceed as follows in the shredding device according to the invention. First of all, it can be checked whether or not the amount of wear at the rotor tools is still within the tolerable range. If so, the wedge segments 280 are removed, and the upper counter knife segments are displaced toward the rotor by the adjustment mechanism 232 until they touch or almost touch the rotor tools. Thereafter, the lower counter knife segments 250 are displaced by means of the adjustment mechanism 252 toward the rotor until they are machined to the desired clearance "zero" by the shredding tools on the rotor. This process can be carried out during a maintenance period with the rotor running, however at a reduced rotational speed. To avoid that the shredding tools on the rotor become excessively worn during this process, the lower counter knife bar or its segments with respect to the shredding tools on the rotor is designed to be "soft", which means that the lower counter knife bar wears down more than the rotor tool bar.

But it is also possible first to displace the lower counter knife bar in the manner described above and thereafter the upper counter knife bar in the manner described above.

If the segments on the lower or on the upper counter knife bar are worn down to such an extent that they cannot be adjusted any longer, the corresponding segments must be exchanged. To this end, the respective counter knife traverse is removed from the machine housing of the shredding device and is rolled radially outwards on the supporting plate 30 as far as to the limit stop 35, in order to make the wearing parts accessible, see FIG. 4. If the tools on the rotor are worn down beyond a predetermined tolerance, the knife segment 130 must be reversed or exchanged, see FIG. 2.

Figure 9:
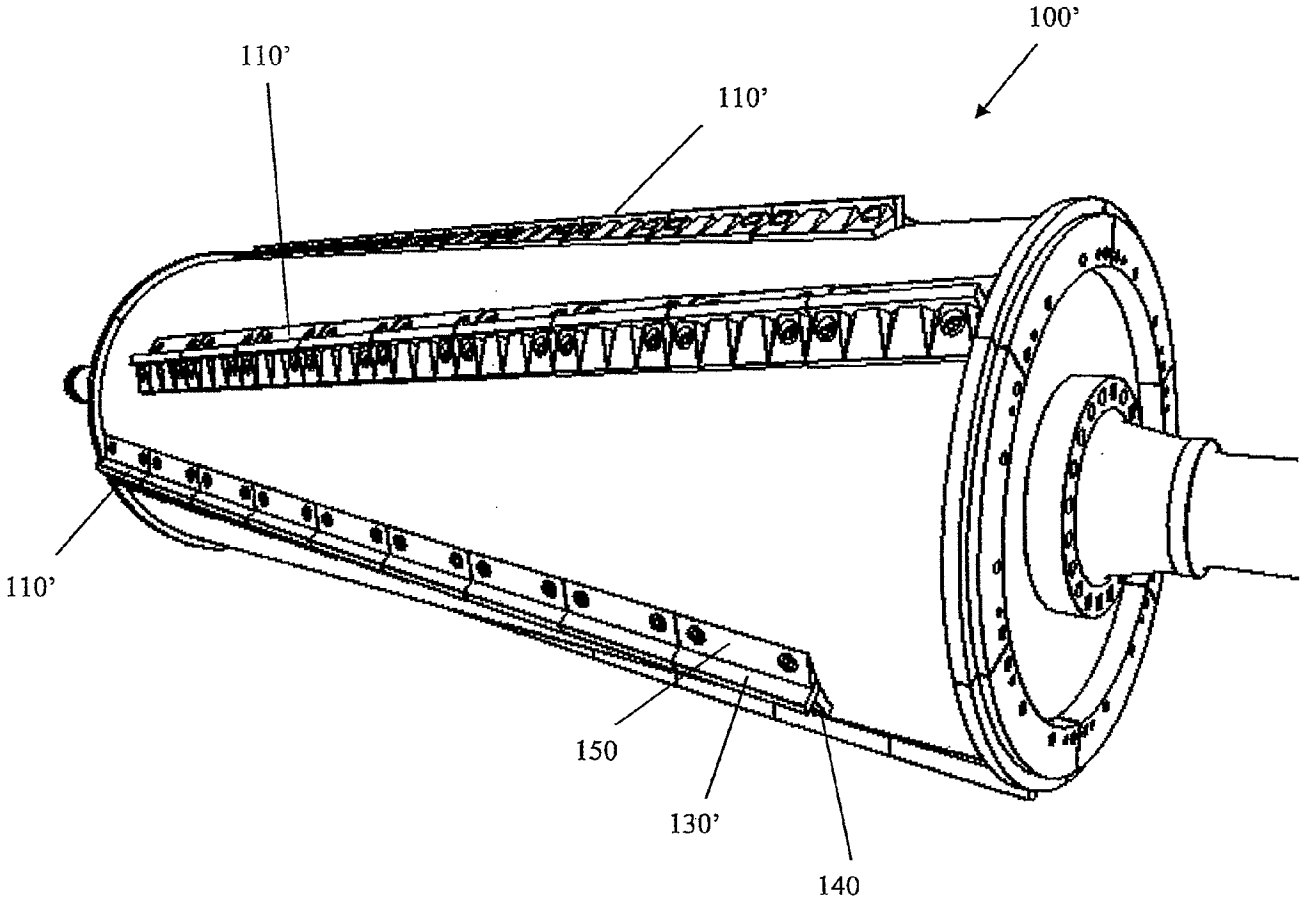
FIG. 9 a rotor with plain knife bars of a second embodiment.
Figure 10:
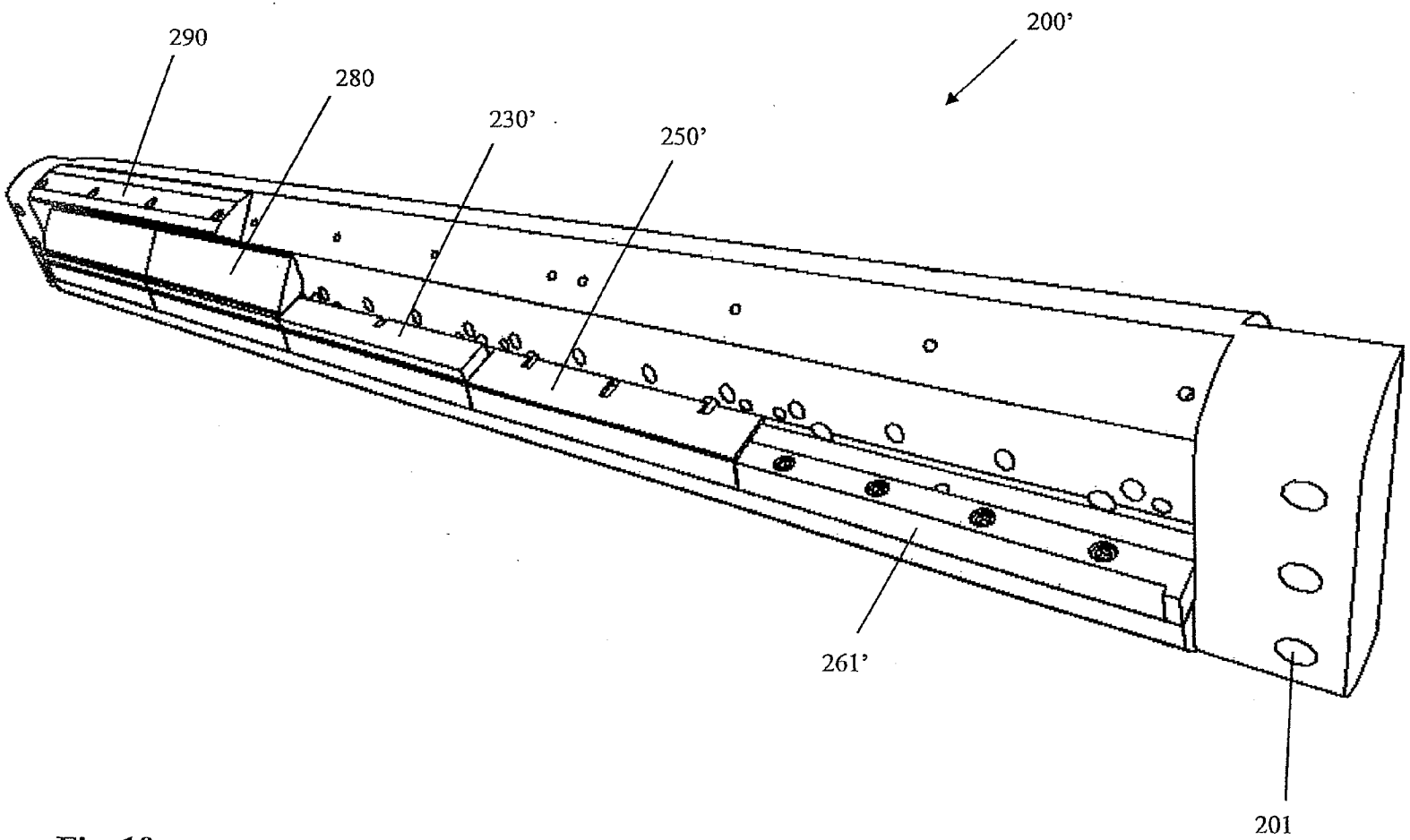
FIG. 10 a counter knife traverse for cooperation with the rotor shown by FIG. 9.

The FIGS. 9 and 10 show the structure of the rotor 100' or the counter knife traverse 200' in an embodiment using plain or block knife bars. As illustrated in FIG. 9, rotor knife bars 110', which are also segmented, are disposed on the circumference of the rotor 100'. In contrary to the above-described example, the knife segments 130' are designed as a block knife having no teeth. In an associated manner, the counter knife comprises an upper counter knife bar and a lower counter knife bar which are also formed as segmented block or plain knifes. Accordingly, in this case, too the teeth in the supporting segments 261 may be omitted. To be recognized are the counter knife segments 250'and 230', which are formed as metal strips and which are arranged in such a manner that they can be radially displaced with respect to the rotor as soon as the wedge 280 has been removed, as described for the above-mentioned embodiment.

List Of Reference Numbers

1 shredding device
20 machine housing
21 legs
22 torque support
23 holder
24 opening
25 sheet metal hopper
26 cutting chamber
30 supporting plate
35 limit stop
40 AC motor
50 conveyor device
51 conveyor motor
100 rotor
100' rotor
105 shaft
106 bearing section
110 rotor knife bar
110' rotor knife bar
120 rotor knife segment
130 knife segment
130' knife segment
131 tooth tip
132 tooth flank
133 tooth flank
140 contact segment
150 clamping segment
160 screwed connection
161 screwed connection
200 counter knife traverse
200' counter knife traverse
201 bolt passage
210 base body
220 upper counter knife bar
230 upper counter knife segment
230' upper counter knife segment
231 adjusting bolt
232 adjustment mechanism
240 lower counter knife bar
250 lower counter knife segment
250' lower counter knife segment
251 adjusting bolt
252 adjustment mechanism
260 support
261 supporting segment
261' supporting segment
262 screwed connection
270 wedge bar
280 wedge bar segment
281 bolt
282 nut
283 plate spring
290 sealing wedge segment
300 supporting structure
310 screen
320 rotation axis
A detail
D thickness of rotor knife
F surface of revolution/operation range of rotor
R rotation direction of rotor

What is claimed is:

1. Shredding device, comprising a driving unit driving at least one rotor, the rotor being rotatable about a rotor axis and having a periphery and having shredding tools on the periphery for comminuting shredding material, the shredding tools being arranged to interact with at least one counter knife assembly that during the shredding operation of the device is arranged in a stationary manner with respect to a machine housing of the device, wherein the counter knife assembly comprises at least two counter knife bars arranged parallel to each other and one above the other in a rotating direction of the rotor, the counter knife bars including a lower counter knife bar and one or more succeeding upper counter knife bars thereabove, the counter knife bars being radially displaceable with respect to the rotor axis by different amounts relative to one another by means of an adjustment mechanism so as to compensate for wear at the shredding tools and/or the counter knife assembly, wherein the lower counter knife bar has a thickness that is lower than a thickness of the shredding tools such that wear that occurs at the lower counter knife bar is higher than wear that occurs at the shredding tools.

2. Shredding device according to claim 1, wherein the lower counter knife bar has a hardness that is lower than a hardness of the shredding tools.

3. Shredding device according to claim 1, wherein the at least two counter knife bars with associated contact surfaces directly lie on one another.

4. Shredding device according to claim 1, further comprising a support of the counter knife assembly on which the lower counter knife bar is supported.

5. Shredding device according to claim 1, further comprising a removable wedge bar supported with one lateral surface on the upper counter knife bar in the rotating direction of the rotor, in order to apply a clamping force, so that the at least two counter knife bars are clamped between a support and the wedge bar.

6. Shredding device according to claim 1, wherein at least one of said counter knife bars is segmented in the longitudinal direction.

7. Shredding device according to claim 1, wherein the counter knife assembly comprises a cylindrical counter knife traverse that is detachably fixed to the machine housing of the shredding device and to which the at least two counter knife bars are fixed.

8. Shredding device according to claim 7, further comprising a supporting device extending radially outwards with respect to the rotor and provided on the machine housing, on which supporting device the counter knife traverse can be rolled, away from the rotor, after the counter knife traverse has been released from the machine housing.

9. Shredding device according to claim 1, wherein the shredding tools and/or the counter knife bar include a tooth structure.

10. Shredding device according to claim 1, wherein the number of shredding tool bars on the rotor is higher than the number of lower counter knife bars over an operating area of the shredding tools.

11. Process for operating a shredding device, comprising driving a rotor to rotate about a rotor axis, the rotor being provided on a periphery thereof with shredding tools for comminuting shredding material, arranging the shredding tools to interact with a counter knife assembly that is stationary with respect to a machine housing during the shredding process, providing at least two counter knife bars for the counter knife assembly which extend approximately parallel to each other and are arranged one above the other with respect to a direction of rotation of the rotor, the counter knife bars including a lower counter knife bar and one or more succeeding upper counter knife bars thereabove, wherein the lower counter knife bar is provided to have a thickness that is lower than a thickness of the shredding tools such that wear that occurs at the lower counter knife bar is higher than wear that occurs at the shredding tools, and displacing the at least two counter knife bars radially by different amounts with respect to the rotor axis for the compensation of wear at the shredding tools and/or the counter knife assembly.

12. Process according to claim 11, characterized in that pre-shredding takes place by the interaction of the upper counter knife bar in the rotating direction of the rotor with the shredding tools acting on the shredding material and re-shredding takes place by the interaction of a lower counter knife bar in the rotating direction of the rotor with the shredding tools acting on the coarsely comminuted shredding material.

13. Process according to claim 11, comprising providing the two counter knife bars to be different from each other in terms of at least one of material, material hardness, and thickness (D).

14. Process according to claim 11, further comprising performing maintenance during a maintenance period, including displacing said upper counter knife bar radially towards the rotor until or almost until the upper counter knife bar contacts at least one of the shredding tools for the compensation of wear at the shredding tools and/or at the upper counter knife bar in the rotating direction of the rotor.

15. Process according to claim 11, further comprising performing maintenance during a maintenance period, including displacing said lower counter knife bar radially up and into a radial operating area of the shredding tools, so that the lower knife bar is machined by the shredding tools to a very small clearance between the shredding tools and the lower knife bar for the compensation of wear of the shredding tools and/or of the lower counter knife bar in the rotating direction of the rotor.

16. Process according to claim 11, comprising, in order to make the counter knife bars accessible for performing maintenance, rolling off the counter knife assembly on a lateral surface thereof, radially away from the rotor, said counter knife assembly being formed by a cylindrical traverse which is detachably supported on the machine housing.

* * * * *